US008800117B2

(12) United States Patent
Fiedler

(10) Patent No.: US 8,800,117 B2
(45) Date of Patent: Aug. 12, 2014

(54) MAGNETIC LOCKING DEVICE

(75) Inventor: Joachim Fiedler, Berlin (DE)

(73) Assignee: Fidlock GmbH, Hannover (DE)

( * ) Notice: Subject to any disclaimer, the term of this patent is extended or adjusted under 35 U.S.C. 154(b) by 999 days.

(21) Appl. No.: 12/373,389

(22) PCT Filed: Jul. 12, 2007

(86) PCT No.: PCT/DE2007/001240

§ 371 (c)(1),
(2), (4) Date: Feb. 5, 2010

(87) PCT Pub. No.: WO2008/006354

PCT Pub. Date: Jan. 17, 2008

(65) Prior Publication Data

US 2010/0287741 A1 Nov. 18, 2010

(30) Foreign Application Priority Data

Jul. 12, 2006 (DE) ..... 10 2006 032 522
Jul. 5, 2007 (DE) ..... 10 2007 031 398

(51) Int. Cl.
*A44B 11/25* (2006.01)
*H01K 1/18* (2006.01)

(52) U.S. Cl.
USPC ..... 24/303

(58) Field of Classification Search
USPC ..... 63/29.2, 900; 24/303, 66.1
See application file for complete search history.

(56) References Cited

U.S. PATENT DOCUMENTS 2,615,227 A * 10/1952 Hornik ..... 24/303
3,266,112 A 8/1966 Heckman
3,589,341 A * 6/1971 Krebs ..... 119/865
5,233,732 A 8/1993 Yamashini
5,323,516 A 6/1994 Hartmann
5,367,891 A * 11/1994 Furuyama ..... 63/29.2
5,515,581 A 5/1996 Kaufmann
5,664,298 A * 9/1997 Nessar-Ivanovic ..... 24/303
6,163,938 A * 12/2000 Weber-Unger ..... 24/303
6,182,336 B1 2/2001 Bauer
6,295,702 B1 10/2001 Bauer
6,505,385 B2 * 1/2003 Grunberger ..... 24/303
6,640,398 B2 * 11/2003 Hoffman ..... 24/303
6,804,865 B2 * 10/2004 Grunberger et al. ..... 24/303
2003/0131452 A1 7/2003 Revel
2003/0229974 A1 12/2003 Zemer et al.
2004/0244419 A1 * 12/2004 Suzuki ..... 63/3.1
2007/0251062 A1 11/2007 Saitoh et al.

FOREIGN PATENT DOCUMENTS

DE 1 226 816 10/1966
DE 299 03 507 8/2000
EP 1 529 459 A 5/2005
FR 1351339 12/1963

(Continued)

*Primary Examiner* — Robert J Sandy
*Assistant Examiner* — Abigail Morrell
(74) *Attorney, Agent, or Firm* — Henry M. Feiereisen LLC

(57) ABSTRACT

A magnetic locking device for closing preferably handbags and similar objects. includes connecting modules each provided with a guide piece having a tubular or trough-like cross section, wherein the guide pieces are formed so as to be fittable into one another, and permanent magnets are arranged at the bottoms thereof, wherein the permanent magnet in the first guide piece is fixedly arranged and the permanent magnet in the guide piece is movably arranged so that, when the device is closed, it is automatically adjusted to the other permanent magnet and brought into an attraction position.

8 Claims, 9 Drawing Sheets

(56) References Cited

FOREIGN PATENT DOCUMENTS

| | | | |
|---|---|---|---|
| FR | 2 394 266 | | 1/1978 |
| FR | 2 361 129 | | 3/1978 |
| FR | 2 394 266 | | 1/1979 |
| FR | 2 612 378 | | 9/1988 |
| GB | 942282 | | 11/1963 |
| GB | 2 264 975 | | 9/1993 |
| RU | 2 096 979 | C1 | 11/1997 |
| RU | 2007 113 550 | | 10/2008 |
| WO | WO 02/21960 | A1 | 3/2002 |
| WO | WO 03/005847 | | 1/2003 |

* cited by examiner

Figure 1:
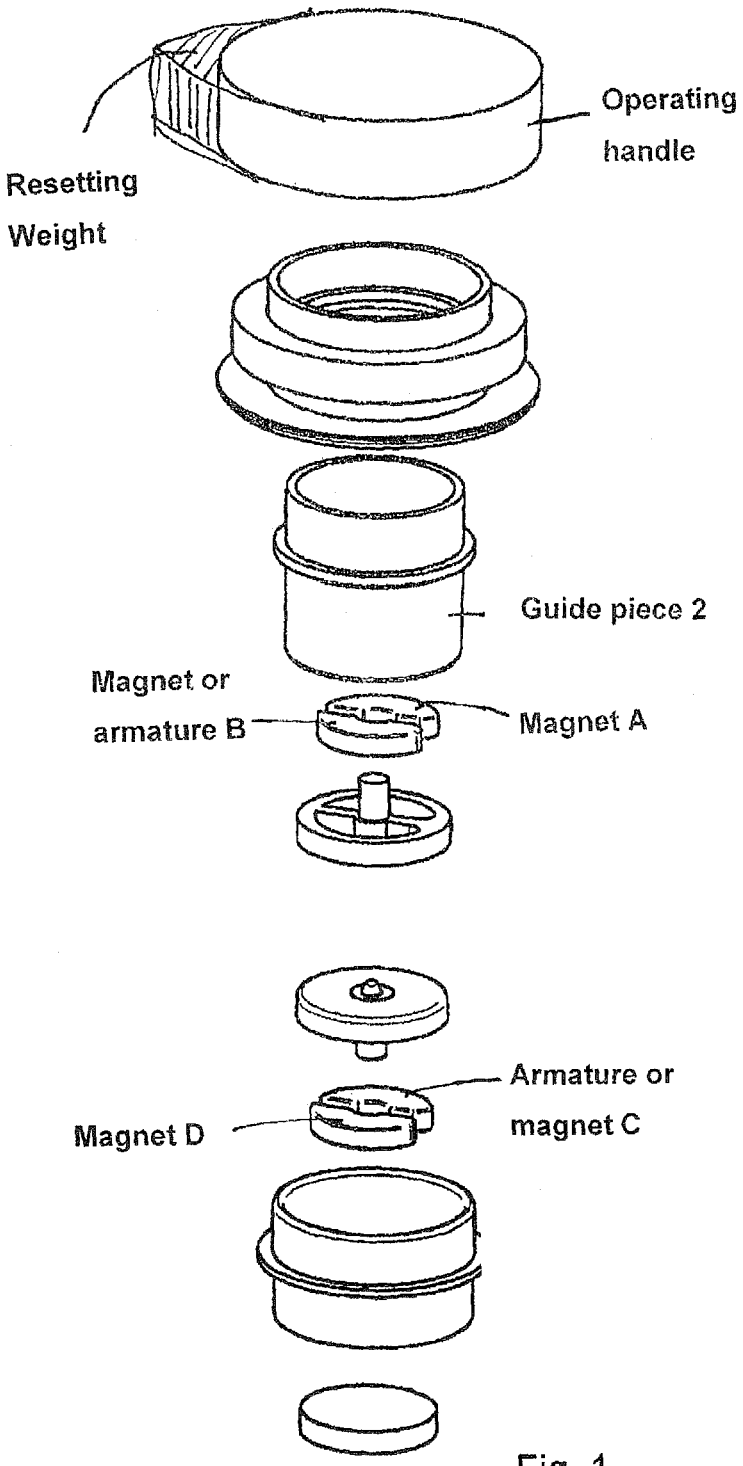

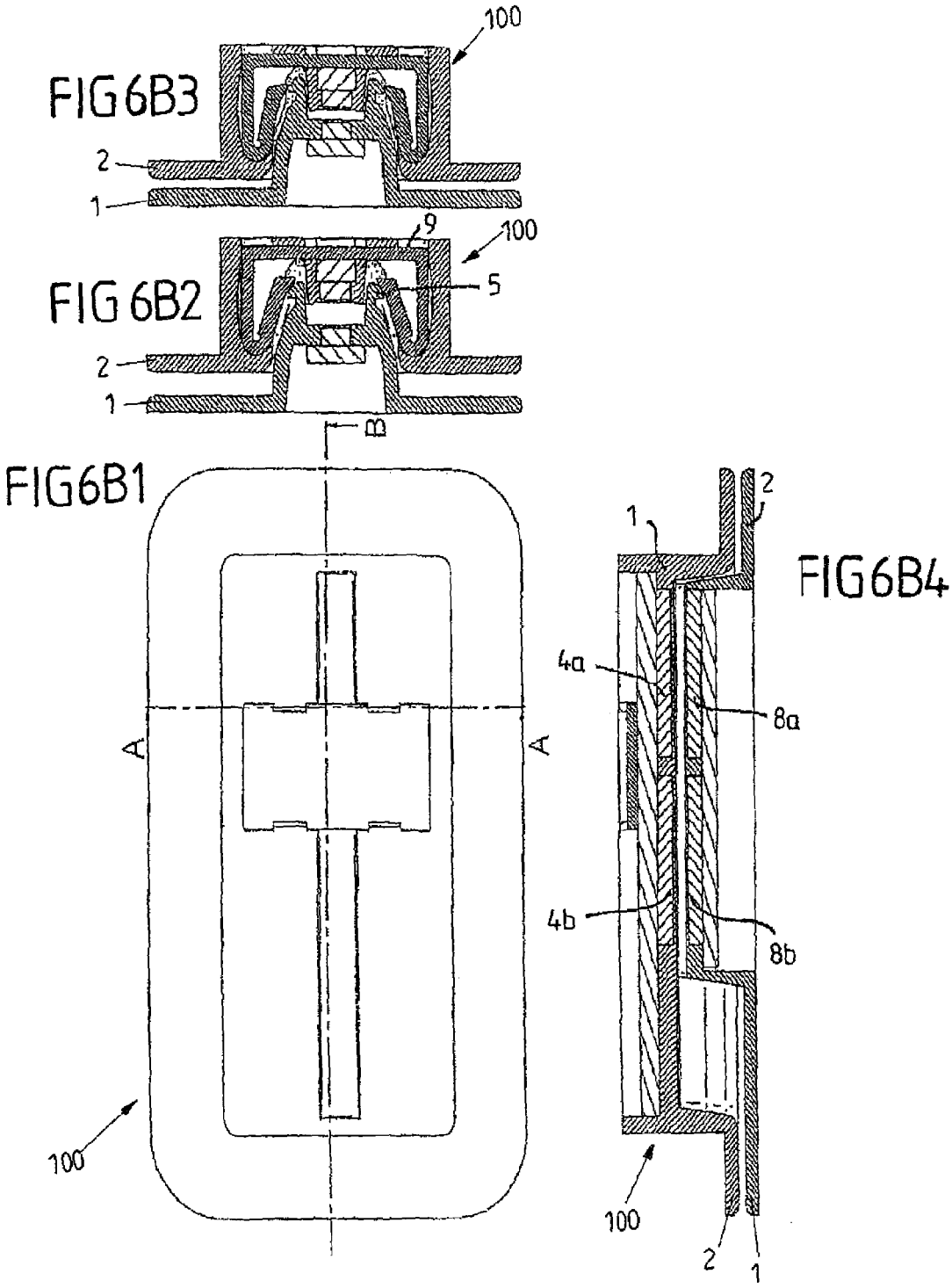
FIG6B3
100
2
1
FIG6B2
9
100
5
2
1
B
FIG6B1
A
A
100
FIG6B4
1
2
4a
8a
4b
8b
100
2
1

FIG 6C2
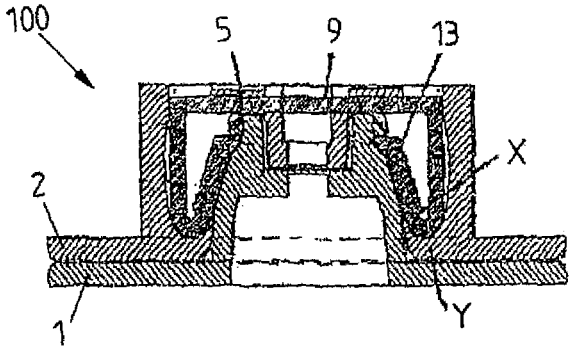
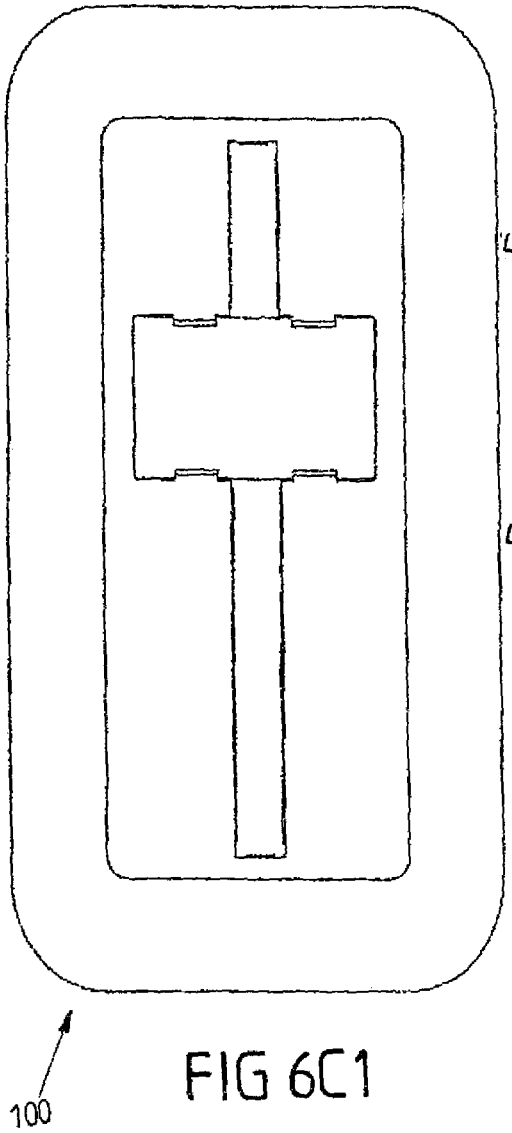
FIG 6C1
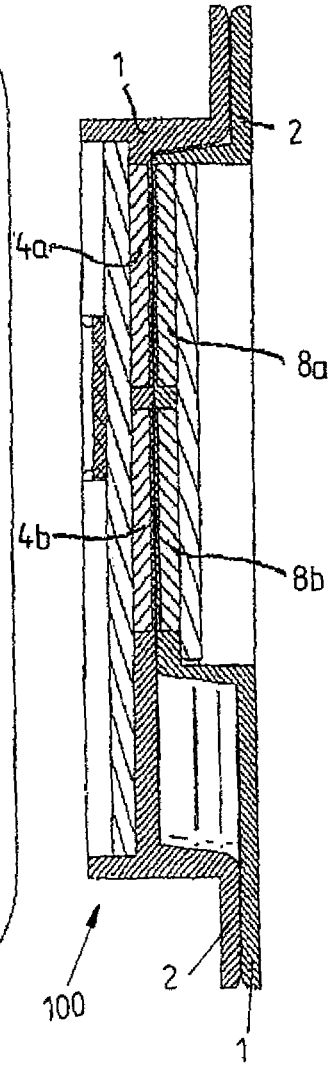
FIG 6C3

FIG 6D2
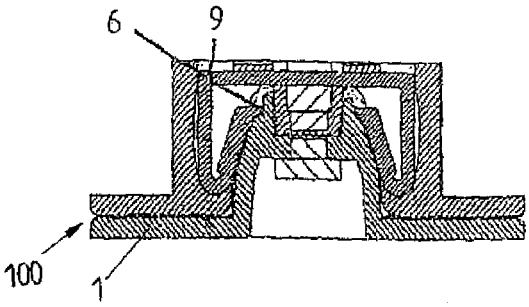
FIG 6D3
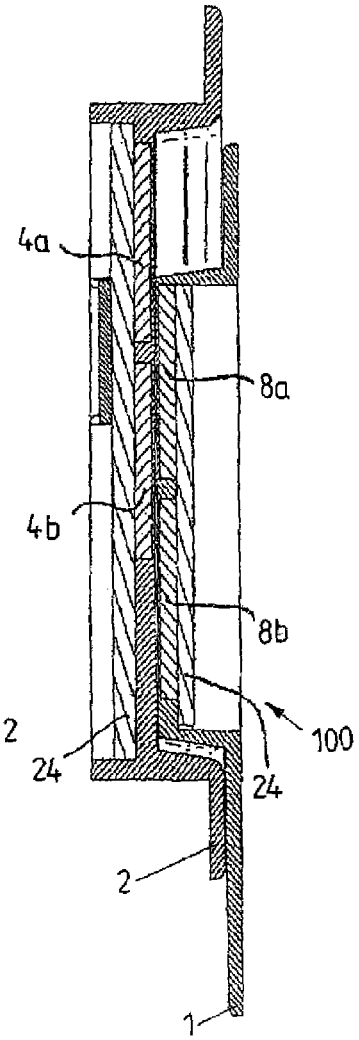
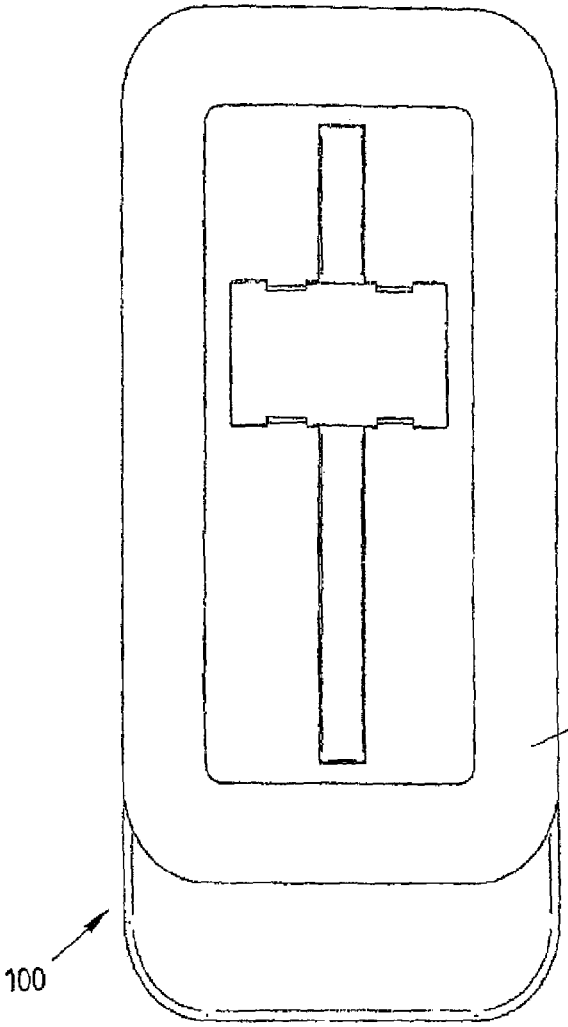
FIG 6D1

MAGNETIC LOCKING DEVICE

The invention relates to a magnetic locking device for locking hand bags and similar objects, preferably. Such locking devices are sufficiently known from the prior art.

However, such locking devices comprise an unsatisfactory haptics, because, due to the greatly nonlinear course of the magnetic attractive forces, opening of the locking device by hand can be done jerkily only. Therefore, it is a steady requirement to improve the opening and closing properties of such locking devices, but in addition, the locking devices must be formed so that the data on credit cards are not erased.

Therefore, object of the invention is to provide a magnetic locking device which comprises a reliable function and an agreeable haptics, and moreover, does not erase the data stored on credit cards.

This problem is solved by a magnetic locking device according to claim 1. This magnetic locking device has two connecting modules for connecting two elements with each other, with one each of the connecting modules being fixable to these elements and comprising at least one permanent magnet. In addition, a tubular or trough-like guide piece is arranged in each of the connecting modules. However, the term tubular is not restricted to circular. The cross section can freely be chosen and be symmetric or non-symmetric in shape. Merely, it has to be considered that the guide pieces are formed so that they can be fitted into one another. The same is true for trough-like guide pieces.

The permanent magnets are arranged on the bottoms of the guide pieces, wherein the permanent magnet in the first guide piece is fixedly arranged, whilst the permanent magnet in the second guide piece is movably arranged so that it will be automatically aligned to the other one into an attracting position when the locking device is closed.

The invention comprises the following advantages:

Due to the guide pieces being fittable into one another, the locking device can be joined easily. As the magnets are arranged within the guide pieces, any credit card sensitive to magnets can not be damaged. When the magnets attract each other, an individual senses a wanted haptic feeling. This feeling gives the impression that the locking device itself closes automatically and safely. Also, a wanted haptic feeling is given when the locking device is opened. This feeling gives the impression that the locking device apparently opens automatically, as the magnetic repulsive forces softly separate the modules from each other—in contrast to a jerky opening procedure as known from the most of the locking devices of this kind according to the prior art. In order that the magnetic locking device according to the invention works reliably, any technical measure must be provided, by which the magnetic shearing forces generated with the opening procedure are received. These shearing forces are received by the guide pieces fitted into one another. Therefore, the guide pieces have a dual function, that is, they serve as distance holders for a credit card and as thrust for the magnetic shearing forces generated with the opening procedure.

In one embodiment, the guide pieces comprise rounded-off or chamfered edges to facilitate fitting them into one another.

In a further embodiment, the guide pieces comprise a backlash to facilitate fitting them into one another.

In a further embodiment, at least one ferromagnetic armature is arranged in addition to the permanent magnet so that, in the closed state of the locking device, the permanent magnet touches the ferromagnetic armature and, for the opening process, the permanent magnets are movable to a repulsive position.

In a further embodiment, the guide pieces are made of a ferromagnetic material, whereby a further shielding of the magnetic field is gained so that the danger of damaging any credit card is still further reduced.

In a further embodiment, the guide pieces have a circular cross section. Therefore, especially simple structures can be created.

In a further embodiment, the movable magnet is provided with a resetting element. This resetting element facilitates the operation of the locking device.

In a further embodiment, the resetting element is a mechanical spring. This embodiment is especially cost-effective.

In a further embodiment, the resetting element is a magnet polarized for repulsion. This embodiment comprises an especially good haptics.

In a further embodiment, the resetting element is a weight which, due to its mass, pushes the movable magnet to its home position when the magnetic locking device is brought into a predetermined spatial position. This embodiment is especially cost-effective.

Below, the invention will be explained in detail by means of a practical example and the accompanying drawings.

FIG. 1 is an exploded view of a first embodiment of the invention

Figure 2A:
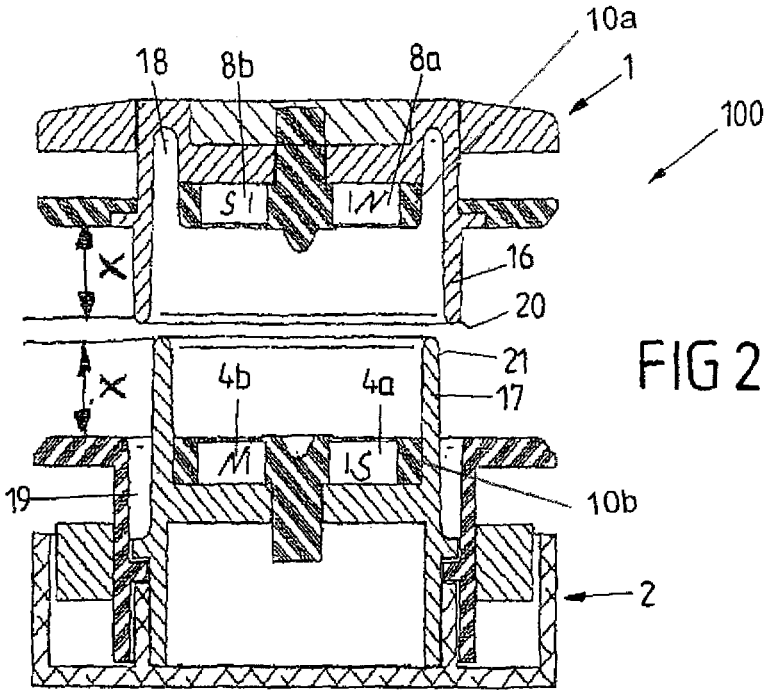
Figure 2B:
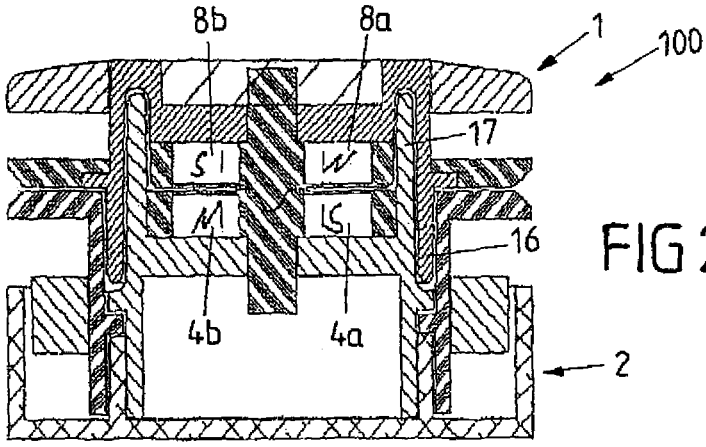
Figure 2C:
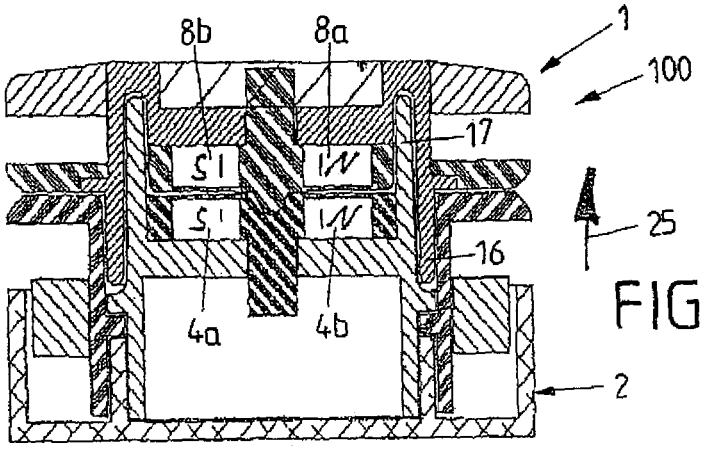

FIGS. 2A-C are cross-sectional views of another embodiment.

Figure 3A:
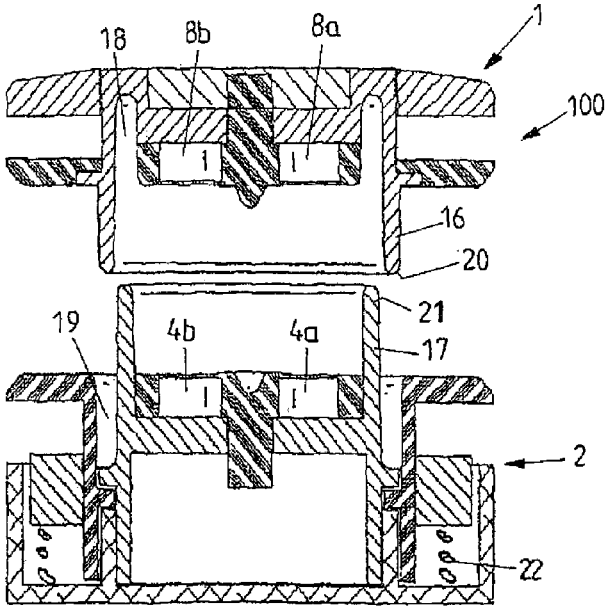
Figure 3B:
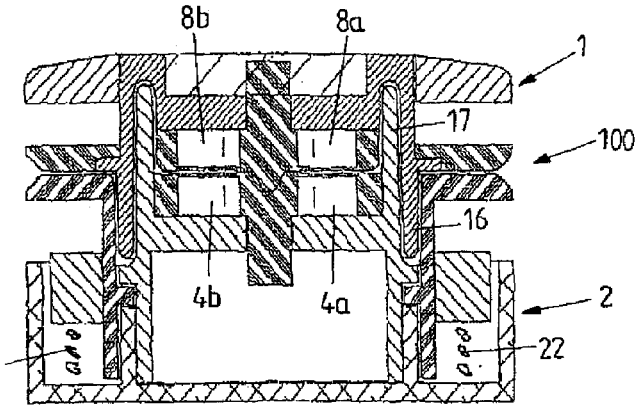
Figure 3C:
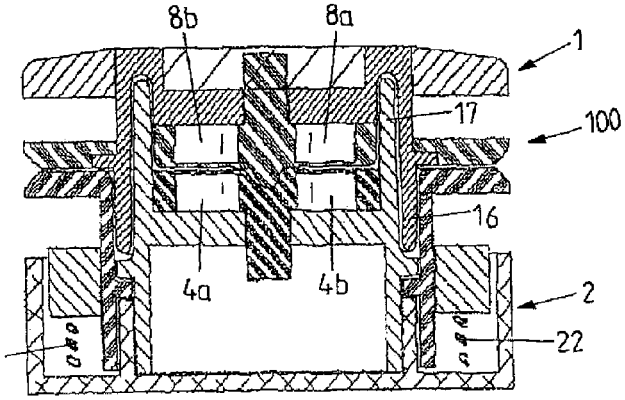

FIGS. 3A-C are cross-sectional views of another embodiment, which is provided with a spring for resetting.

Figure 4A:
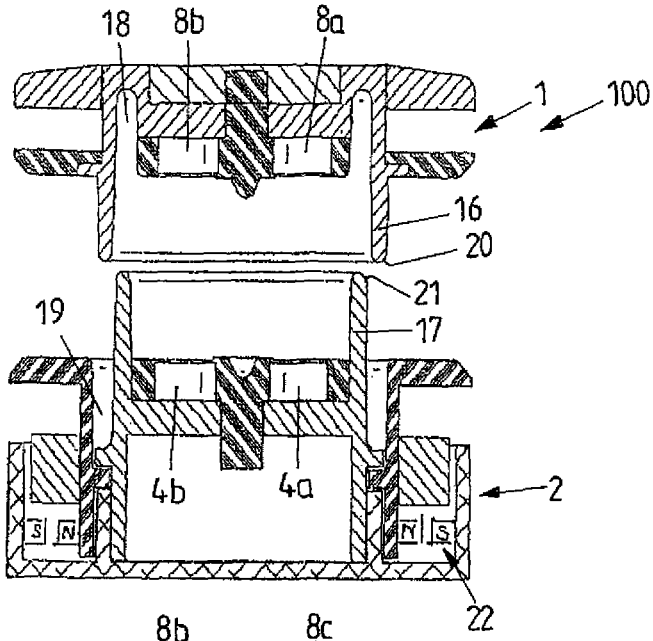
Figure 4B:
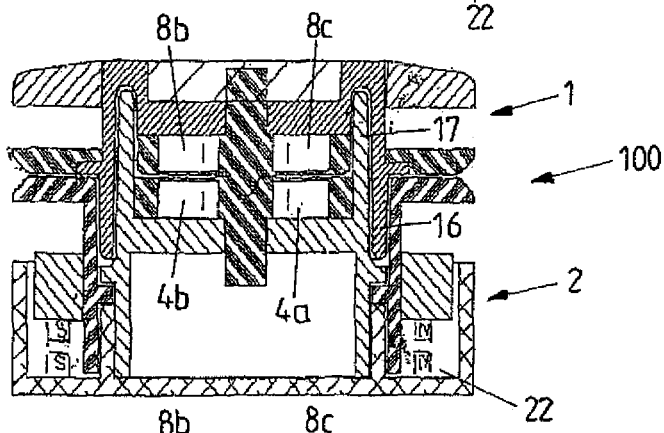
Figure 4C:
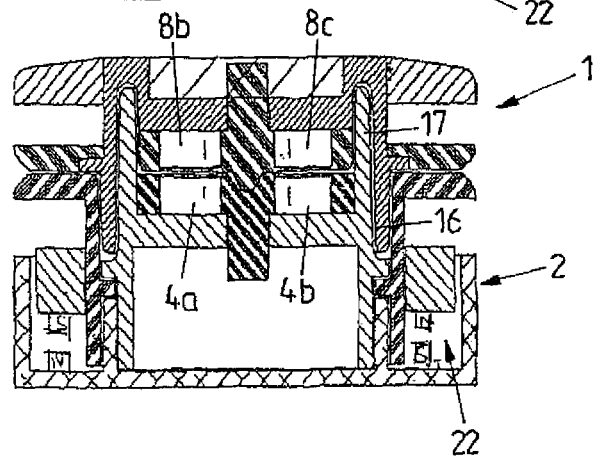

FIGS. 4A-C are cross-sectional views of another, which is provided with a magnet for resetting.

Figure 5A:
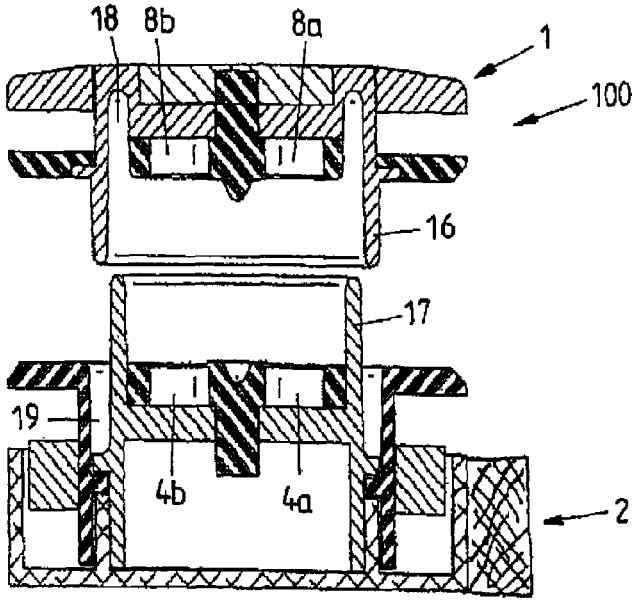
Figure 5B:
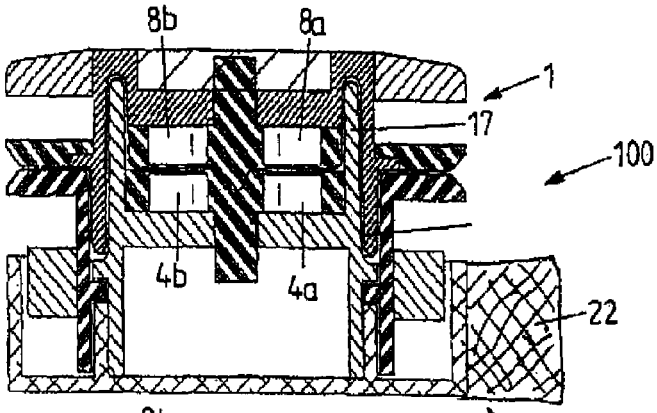
Figure 5C:
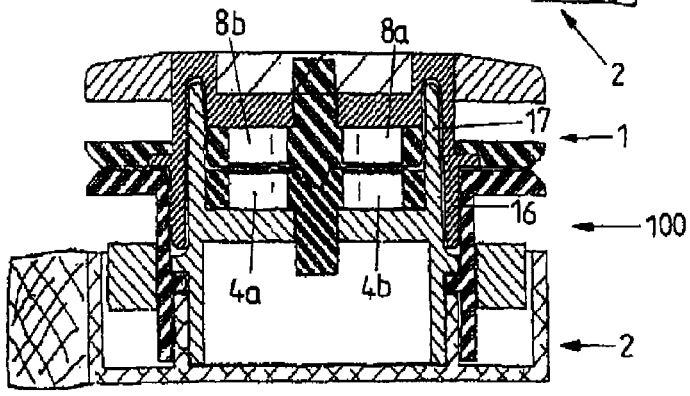

FIGS. 5A-C are cross-sectional views of an embodiment corresponding to the embodiment shown in FIG. 1, which is provided with a weight for resetting.

FIGS. 6A, 6B1-4, 6B1-3, and 6D1-3 show another embodiment of the invention.

FIGS. 6C1-3 show cross sectional views of another embodiment of the invention;

Proceeding from FIG. 1, a locking device 100 includes a polarizable magnet system, which, when turned, closes and opens by magnetic forces. According to the invention, the magnets 4*a*, 4*b*, 8*a*, 8*b* are arranged on the bottom of each of the tubular guide pieces 16, 17. The embodiment shown in FIG. 1 includes actuating element 23 and ring shaped element 24.

As shown for different embodiments in the cross-sectional views according to FIGS. 2A-C to 5A-C, homopolar magnets 4*a*, 4*b*, 8*a*, 8*b* (marked in FIGS. 2A-C by N and S) are in the position of FIGS. 2C, 3C, 4C, and 5C opposite to one another so that the locking device 100 opens automatically, that is, the upper part 1 is repelled in the direction marked by arrow 25.

As shown in the cross sectional views according to FIGS. 2A, 3A, 4A, and 5A, the magnets 4*a*, 4*b*, 8*a*, 8*b* are arranged in respective bottom sections 10*a*, 10*b* at a distance x from the upper edge of each of the tubular guide pieces 16, 17. This distance x was chosen so that credit cards are not damaged. Furthermore, the drawings show that the guide pieces 16, 17 are slightly rounded at their upper edges 20, 21 so that they fir into one another very well. When the locking device 100 is in the closed state, the tubular guide pieces 16, 17 project into recesses 18, 19 of the respective counterpart so that the magnets 4*a*, 4*b*, 8*a*, 8*b* attracting each other are close to one another.

FIGS. 3A-C are cross-sectional views of an embodiment, which is provided with a resetting element 22 in the shape of a resetting spring for resetting the locking device 100 into its home position.

FIGS. 4A-C are cross-sectional views of an embodiment, which is provided with a resetting element in the shape of a resetting magnet for resetting the locking device 100 into its home position.

FIGS. 5A-C a cross-sectional views of an embodiment, which is provided with a resetting element 22 in the shape of a resetting weight for resetting the locking device 100 into its home position gravimetrically. This embodiment is used where a defined spatial mounting situation is given, at a cupboard, for example.

Figure 6A:
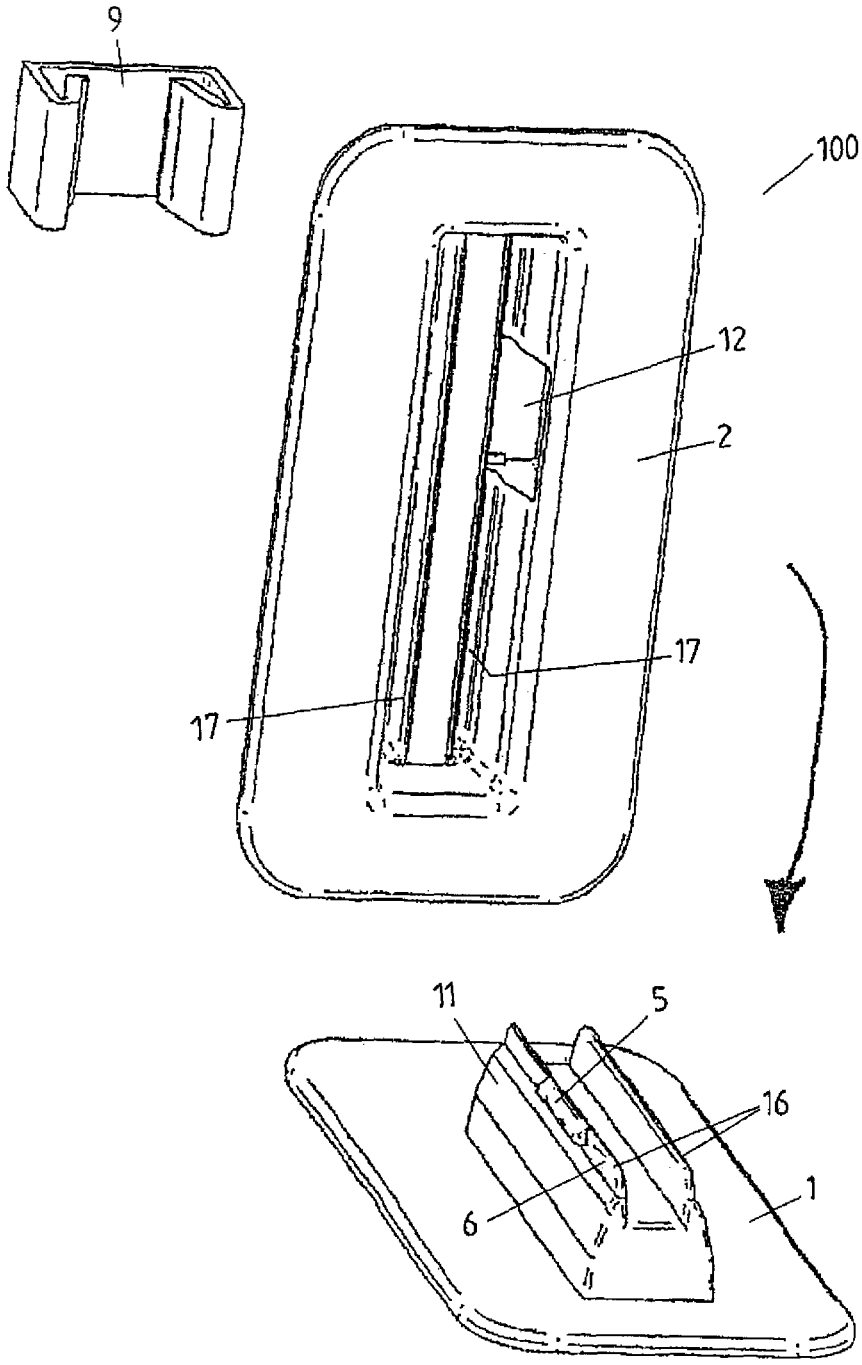

FIGS. 6A, 6B1-4, 6C1-3, and 6D1-3 show an embodiment of a locking device 100 which carries out a rectilinear opening movement. FIG. 6*a* is a perspective view of the substantial constituents of this locking device 100. The locking device 100 is composed of connecting modules 1, 2 which are fixed to a bag. On principle, fixing can be done in different kinds and ways, by sewing, sticking, riveting or screwing, for example. An expert skilled in this field knows how to fix products of this kind, and therefore, fixing will not further be explained in the description of the following embodiments. A first connecting module 1 is formed as plug having a wedge-like plug-in section 11 which extends in lengthwise direction thereof. The plug-in section 11 is provided with a fixed arresting piece 5 having an interstice 6. A separately shown flexible locking element 9 is inserted into a recess 12 of a second connecting module 2. Magnets 4*a*, 4*b*, 8*a*, 8*b* are shown in the other figures.

FIG. 6B1-4 show two cross-sectional views A-A (FIGS. 6B2, 6B3), from which it is recognizable how the connecting modules 1, 2 lock themselves with each other. In the state shown in the cross-sectional view A-A-1 (FIG. 6B2), the flexible locking element 9 rests on the arresting piece 5. This state corresponds to the operation phase shown in FIG. 1*b*. In the state shown in the cross-sectional view A-A-2 (FIG. 6B3) the flexible locking element 9 has already been bent back.

The positions of the magnets 4*a*, 4*b* and of the armatures 8*a*, 8*b* made of a ferromagnetic material are recognizable from the cross-sectional view B-B (FIG. 6B4). An expert skilled in this field knows that the armatures 8*a*, 8*b* can also be magnets. The positions of the magnets 4*a*, 4*b* and the armatures 8*a*, 8*b* must be determined by an expert so that, as shown in the cross-sectional view B-B (FIG. 6B4), both the connecting modules 1, 2 attract each other, that is, either two magnets 4*a*, 4*b*, 8*a*, 8*b* attracting each other or a magnet 4*a*, 4*b* and an armature 8*a*, 8*b* must be positioned opposite to each other. For example, when magnets 4*a*, 4*b* are positioned opposite to magnetic armatures 8*a*, 8*b* and attract each other, the magnets 4*a*, 4*b* and the magnetic armatures 8*a*, 8*b* are of different denomination. When the magnets 4*a*, 4*b* and the magnetic armatures 8*a*, 8*b* are displaced to each other, surfaces having the same polarity are positioned opposite to and therefore repel each other, which will be understood when the separation of the connecting modules 1, 2 is described.

FIG. 6C1-3 are the same as FIG. 6B1-4, with the difference that the flexible locking element 9 and the arresting piece 5 are locked with each other, recognizable from the cross-sectional view A-A (FIG. 6C2). That is, the locking device 100 is closed. It must be mentioned that the flexible locking element 9 is supported on its total surface by the supporting area 13 and is almost exclusively stressed by pressure when the assembly is loaded, whereby the assembly becomes very stable.

FIG. 6D1-3 show the opening procedure, during which the connecting module 2 is displaced to the left side. That is, the flexible locking element 9 is positioned opposite to the interstice 6 and therefore, is not engaged with the arresting piece 5 any more. Displacing of the connecting module 2 also causes the magnet-armature unit 4*a*, 4*b*, 8*a*, 8*b* to be displaced.

As shown in FIG. 6D1-3, magnetic guide plates 24 are arranged behind the magnets 4*a*, 4*b*. In this practical example, the magnetic guide plates 24 serve to improve the utilization of the magnetic force by short-cutting the magnetic fields emerging from the backside and to shield the content of a bag, such as credit cards, from unwanted magnetic fields.

It can also be seen from the drawings that the magnets 4*a*, 4*b* are arranged in recesses and the guide pieces 16, 17 are formed so that the connecting modules 1, 2 are reliably joinable.

The invention claimed is:

1. A magnetic locking device, comprising:

two connecting modules;

at least one magnet means arranged in each of the two connecting modules, with a magnetic attraction between the modules being at least attenuated by a turning movement of the two connecting modules with respect to each other about a turning axis, wherein each of the two connecting modules comprises a tubular guide piece and a recess, said guide piece having a circular cross section, wherein the guide piece of a first one of the two connecting modules is fittable into the recess of a second one of the two connecting modules and the guide piece of the second one of the two connecting modules is fittable into the recess of the first one of the two connecting modules along the turning axis, wherein each of the two connecting modules further comprises a bottom section encircled by the guide piece of the connecting module, the guide piece protruding beyond the bottom section in a direction along the turning axis, and wherein the magnet means of the first one of the two connecting modules and the magnet means of the second one of the two connecting modules are arranged on the bottom section.

2. The magnetic locking device of claim 1, wherein the guide piece of each connecting module comprises a chamfered or rounded edge to facilitate fitting of the guide piece of the first connecting module into the recess of the second connecting module and fitting of the guide piece of the second connecting module into the recess of the first connecting module.

3. The magnetic locking device of claim 1, wherein the magnetic means comprise at least one ferromagnetic armature and a permanent magnet, wherein, in a closed state of the magnetic locking device, the permanent magnet of one of the connecting modules abuts upon the ferromagnetic armature of another one of the connecting modules and, for opening the magnetic locking device, the permanent magnets of the connecting modules are turnable with respect to each other into a repulsion position.

4. The magnetic locking device of claim 1, wherein the guide pieces are made of a ferromagnetic material.

5. The magnetic locking device of claim 1, further comprising a resetting element provided on a movable one of the permanent magnets.

6. The magnetic locking device of claim 5, wherein the resetting element is a mechanic spring.

7. The magnetic locking device of claim 5, wherein the resetting element is magnet polarized for repulsion.

8. The magnetic locking device of claim 5, wherein the resetting element is a weight which, due to its mass, pushes the movable one of the permanent magnets into a home position when the magnetic locking device is brought into a predetermined spatial position.

* * * * *